United States Patent [19]

Chamdru et al.

[11] 4,127,159

[45] Nov. 28, 1978

[54] TIP FOR FOUNDRY CORE BLAST PIPE

[75] Inventors: Jacques Chamdru, Le Mesnil Saint Denis; Marcel Guilloton, Aulnay sous Bois, both of France

[73] Assignee: Regie Nationale des Usines Renault, Boulogne-Billancourt, France

[21] Appl. No.: 675,792

[22] Filed: Apr. 12, 1976

[30] Foreign Application Priority Data

Apr. 10, 1975 [FR] France ..... 75 11176
Jul. 28, 1975 [FR] France ..... 75 23421

[51] Int. Cl.[2] ..... B22C 15/24
[52] U.S. Cl. ..... 164/200; 141/392
[58] Field of Search ..... 164/200, 201, 202; 141/311, 392; 425/247; 215/317

[56] References Cited

U.S. PATENT DOCUMENTS

| | | | |
|---|---|---|---|
| 926,550 | 6/1909 | Dafoe | 141/392 X |
| 2,761,186 | 9/1956 | Peterson | 164/200 |
| 3,235,921 | 2/1966 | Bego et al. | 164/200 |
| 3,901,401 | 8/1975 | Lynn et al. | 215/317 X |
| 3,903,952 | 9/1975 | Bego et al. | 164/200 |
| 3,989,089 | 11/1976 | Deguchi | 164/201 |

*Primary Examiner*—Robert D. Baldwin
*Attorney, Agent, or Firm*—Oblon, Fisher, Spivak, McClelland & Maier

[57] ABSTRACT

A tip for a pipe of the type used in foundries for the fabrication of molds and sand cores by sand blasting in an appropriate foundry installation is made of plastic material and has its exterior portion in the form of an essentially cylindrical part on the side connected to the blast pipe and of a coupling cone in one of the filling holes of the core molds on the other side of his pipe. It is distinguished by the fact that this coupling cone is connected to the essentially cylindrical external portion by an elastically supported essentially circular shoulder on the upper wall of the core mold, thus achieving a tight fit by exerting a horizontal thrust on the core mold. Application to mass production of sand cores by blasting, particularly by means of rigid metal blast pipes, is attained through this invention.

4 Claims, 8 Drawing Figures

TIP FOR FOUNDRY CORE BLAST PIPE

BACKGROUND OF THE INVETION

1. Field of the Invention

This invention, relates generally to tips of blast pipes or nozzles of the type used in foundries for construction of sand molds and cores by sand blasting within a suitable foundry installation.

2. Description of the Prior Art

The most common method employed for this purpose uses metal pipes attached to a filling cylinder and furnished with a plastic tip which includes a coupling cone made to match with corresponding holes formed in the core mold. Nevertheless, since these pipes are made of metal, they are inevitably rigid and therefore are not suitable for compensating for the residual misalignment existing with the corresponding holes of the core mold. As a result, the tips of the pipes often do not fit properly in these holes and frequently produce leaks that interfere with the proper functioning of the assembly.

A second solution, among others, for overcoming these drawbacks, which is described in French patent application No. 74/27,000 in the name of the applicant, uses plastic pipes. This solution proves to be entirely satisfactory since it permits compensating for the aforementioned defects in alignment.

SUMMARY OF THE INVENTION

Nevertheless, since the majority of present day installations are still equipped with rigid metal pipes, it is a primary object of this invention to provide an improved foundry core blast pipe, which uses this solution to obtain operational conditions comparable to those furnished by plastic pipes while, at the same time requiring only minor modifications to these installations which can be made at a very low cost. Therefore, the tip of the foundry core blast pipe of this invention, which is made of plastic, includes a wide central bore, intended to be used for filling, its exterior being formed of an essentially cylindrical portion on the connecting side of the blast pipe and of a coupling cone in one of the filling holes of the core mold on the opposite side of this pipe. This tip is essentially distinguished by the fact that the coupling cone is connected to the essentially cylindrical external portion by means of an essentially circular elastic supporting shoulder on the upper wall of the core mold, thus assuring a tight fit due to horizontal thrust applied to the aforementioned core mold.

Furthermore, the central filling hole of this tip includes, in the direction of the coupling cone, an internal concentric cone of smaller taper and in the same direction as that of the coupling cone, so that the thickness of the shell formed by the aforementioned tip is progressively reduced towards its lower end and terminates essentially in the form of a rim that is essentially circular, thus furnishing a second means of assuring a tight fit by overlaying (due to internal pressure that occurs during filling) of this coupling cone in its seat which has been made in the core mold.

Finally, in a preferred variation of making the tip of the blast pipe in accordance with the present invention, a narrow groove is made at the point of connection between the essentially circular shoulder and the coupling cone of the said tip in the core mold in such a way as to improve, due to the elastic deformation of the aforementioned shoulder, the tightness of fit which the latter achieves because of its thrust against the upper wall of the core mold.

Thus, the tip of the foundry core blast pipe, which is the subject of this invention, makes it possible to obtain two methods of achieving tightness of fit between the blast system and the core mold. One method depends on the horizontal thrust of its essentially circular shoulder on the core mold while the other method takes advantage of overlaying during filling of its coupling cone on its own seat which is made in this core mold. These are both simple and inexpensive means of achieving this objective.

Mounting of this tip on the body of the pipe is easily accomplished by first immersing it in hot water for a few moments. Depending on the setup, it can be used with pipes which may or may not incorporate a cooling system.

For use with so-called "Hot box" installations, it is desirable to make this tip of a fluoridated elastomer of the type marketed by the Dupont de Nemours Company under the brand name of VITON. If this tip is to be used with installations where the core is baked, rather than hardened by chemical means, it may be constructed of polyurethane, polyvinyl chloride or some similar material.

Finally, due to its double tightness of fit, this blast pipe tip may be constructed in any shape, such, oblong, for example, in accordance with the requirements for the particular application.

In order to facilitate assembly operations and to avoid long down times of assembly lines of foundry molds and cores during the replacement of defective pipe, it should be possible to remove and replace these rapidly and easily.

In order to obtain such a result, one objective of this application consists in having the essentially cylindrical part include, at its end which connects with the blast pipe, an internal elastic flange which is adjacent to a recessed groove and which will fit into a recessed groove in back of a flange at the end of the aforementioned blast pipe as well as at least one small external tongue which extends radially from the essentially cylindrical part and which may be pulled so as to deform the internal elastic flange of the aforementioned tip so as to facilitate installing and removing it.

In accordance with the present invention, the small external tongue also includes, at the end opposite to that which is mounted on the essentially cylindrical part, a bead which constitutes a reinforcement and facilitates gripping of the aforementioned small tongue. Since this small tongue and its bead come directly from the casting together with the tip, which may be of any shape whatsoever, such as oblong, for example, we thus obtain a particularly economical monobloc assembly whose forms may be stripped along a central joining plane, thus avoiding any peculiar manufacturing problems.

BRIEF DESCRIPTION OF THE DRAWINGS

Other objects, features and attendant advantages of the present invention will be more fully appreciated as the same becomes better understood from the following detailed description when considered in connection with the accompanying drawings, wherein like reference numerals designate like or corresponding parts throughout the several views, and in which.

DETAILED DESCRIPTION OF PREFERRED EMBODIMENTS

Figure 1:
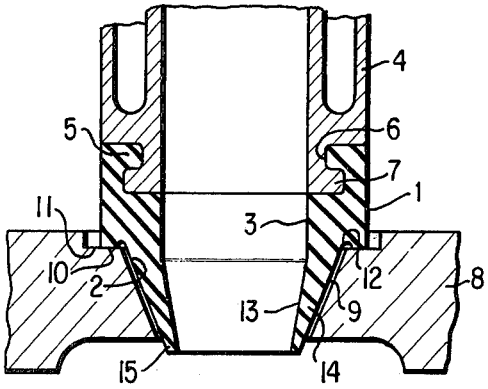
FIG. 1 is a longitudinal axial cross-sectional view of a blast pipe tip in accordance with the present invention, having a generally circular shape and associated with a blast pipe using a cooling system.
Figure 2:
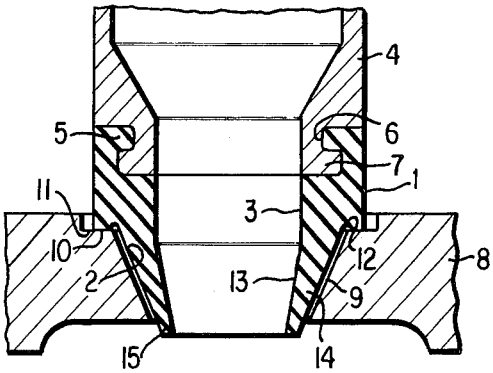
FIG. 2 is a longitudinal axial cross-sectional view of a blast pipe tip in accordance with the present invention, having a generally circular shape and associated with a blast pipe which does not use a cooling system.
Figure 3:
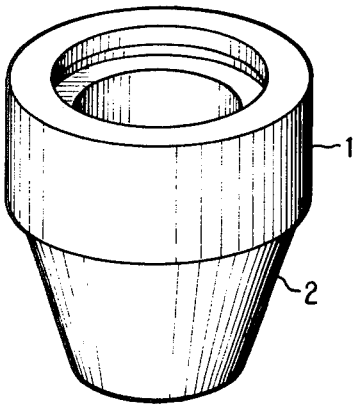
FIG. 3 is a perspective view of the blast pipe tip shown in FIGS. 1 and 2.

Referring now to the drawings, and more particularly to FIGS. 1-3 thereof, a tip for a foundry core blast pipe which is made of a plastic material as specified previously, consists of a cylindrical part 1 and a conical part 2 and includes a large central bore 3 which is intended for filling. The tip is connected to a blast pipe 4, which may be furnished with a cooling system, as shown in FIG. 1, or without one, as shown in FIG. 2, by its cylindrical portion 1 through an internal elastic flange 5 which, after being immersed for a few moments in hot water, will fit into a recessed groove 6 which is located behind a flange 7 at the end of the blast pipe 4.

The tip is also connected to an upper wall 8 of the core mold by coupling its conical portion 2 with a corresponding conical orifice 9 in the upper wall 8 of the core mold which thus forms a seat for the tip.

The conical portion 2 of the blast pipe tip of this invention is connected with its cylindrical portion 1 by means of an elastic supporting circular shoulder 10 which rests on the upper wall 8 of the core mold, thus providing a tight fit due to the horizontal thrust on the core mold. This arrangement, which does not create any additional difficulties for obtaining blast pipe tips by casting under pressure, as the tips can easily be stripped along a central joining plane, needs only local surfacing in the form of a slight milling 11 of the corresponding portion of the external face of the upper wall 8 of the core mold in order to furnish a proper bearing surface for the circular shoulder 10. Furthermore, this surfacing may be performed together with the operation of machining the conical orifice 9, this making it possible to limit the cost price of this improvement to a small value.

In a preferred method of construction of this invention, in order to improve the tightness of fit by means of elastic deformation which is obtained by the support of circular shoulder 10 on milled portion 11 of the upper wall 8 of the core mold, a narrow circular groove 12 is provided at the junction of the coupling cone portion 2 and the circular shoulder 10.

Finally, the central filling bore 3 of the blast pipe tip includes, at the conical coupling cone end 2, an internal concentric cone 13 with a lower value of taper and in the same direction of the conical coupling cone 2, so that the thickness of the shell 14 formed by the blast pipe decreases progressively towards its lower extremity, ending essentially in the form of a circular rim 15. Thus, a second means of tightness of fit is achieved, by means of layering, due to internal pressure exerted during filling, for this conical coupling cone 2 on its conical seat 9 made on the upper wall 8 of the core mold.

Figure 4:
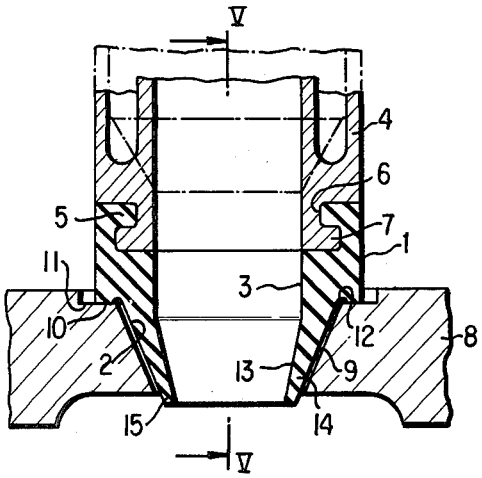
FIG. 4 is a transverse axial view in cross section taken along the line IV—IV of FIG. 5 of a blast pipe tip made in accordance with the present invention and having a generally oblong shape.
Figure 5:
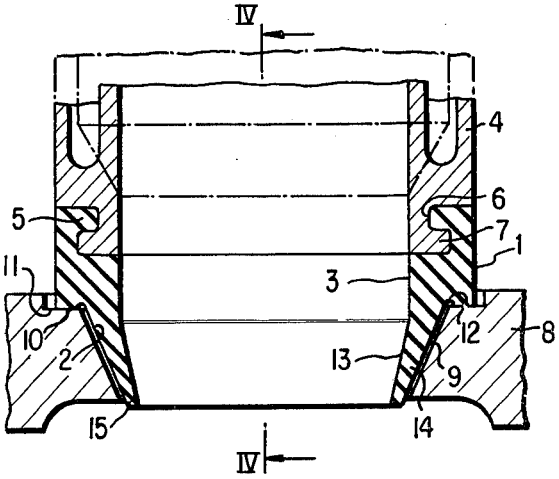
FIG. 5 is a longitudinal axial view in cross section taken along the line V—V of FIG. 4 of the blast pipe tip having a generally oblong shape and shown in FIG. 4.
Figure 6:
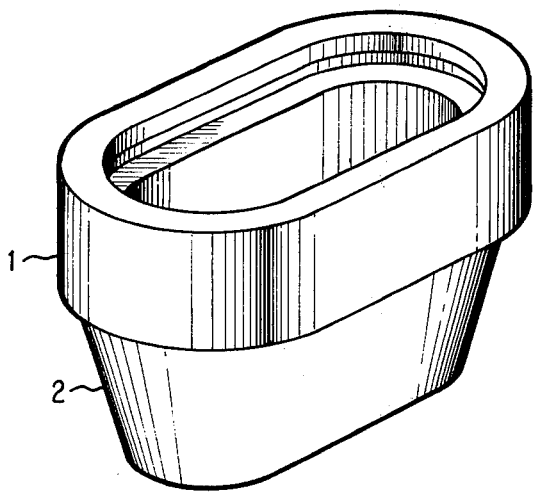
FIG. 6 is a perspective view of the blast pipe tip shown in FIGS. 4 and 5.

The double tightness of fit thus achieved by this blast pipe tip also permits avoiding the constraint of using only circularly shaped blast pipe tips and makes it possible to employ different variations of shape for different applications. Accordingly, the blast pipe tip of this invention can be advantageously used, for example, in an oblong shape, as depicted in FIGS. 4 to 6, without running into any special problem, since its forms are easy to strip along a central joining plane. The tip shown in FIGS. 4 to 6 differs from the one shown in FIGS. 1 to 3 only by the fact that it has a generally elongate shape. It may also be used with blast pipes supplied with a cooling system, as shown by solid lines in FIGS. 4 and 5, or without a cooling system as shown by dots and dashes on the aforementioned figures.

Figure 8:
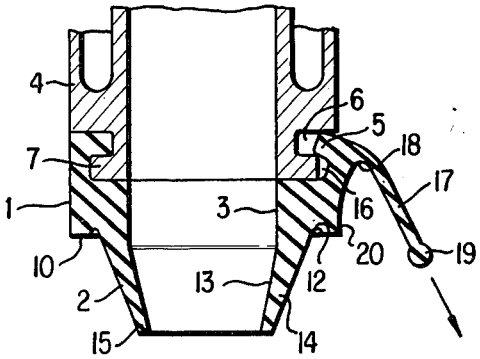
FIG. 8 is a transverse view in cross section taken along the line VIII—VIII of FIG. 7 of a blast pipe tip made in accordance with the present invention, shown at the time that it is being removed from its blast pipe.
Figure 7:
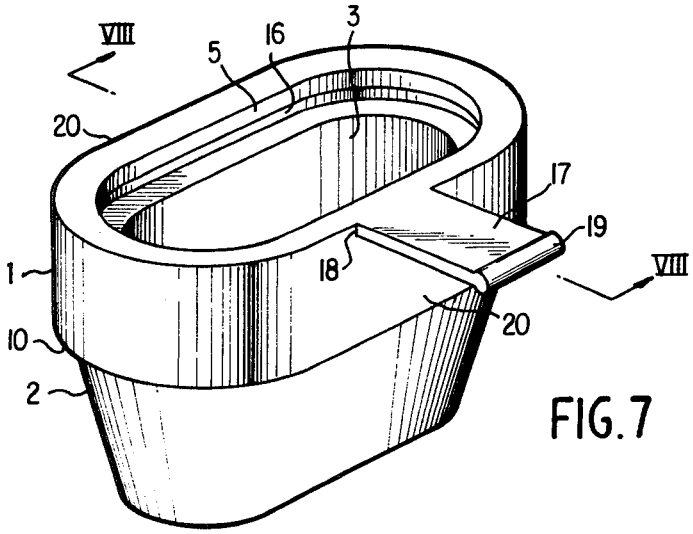
FIG. 7 is an isometric projection of a blast pipe tip made in accordance with the present invention, having a generally oblong shape and furnished with a small external tongue.

The tip for foundry core blast pipes, which is depicted in FIGS. 7 and 8, is connected to a blast pipe 4 by the end of its essentially cylindrical portion 1, in this case more precisely being of an oblong or race-track configuration, which is opposite the tapered coupling portion 2, with the help of an internal elastic flange 5, located at this end and adjacent to a recessed groove 16, which flange, after being immersed for a few moments in hot water, will fit into a groove 6 that forms a recess behind the flange 7 which is located at the end of the aforementioned blast pipe 4.

The blast pipe tip also includes a small external tongue 17 that extends radially from the essentially cylindrical or oblong portion 1 and which may be pulled downward, as illustrated in FIG. 8, so as to separate a portion of the internal elastic flange 5, by deforming it, thus facilitating installation and removal of the tip.

The small external tongue 17, which has an essentially rectangular shape, also is equipped, at the end opposite to that by which it is implanted 18 to the essentially cylindrical or oblong part 1, with an elongate approximately cylindrical bead 19 which reinforces and facilitates gripping of the tongue.

Finally, in the preferred method of fabrication, where the blast pipe tip is oblong in shape, the point of attachment 18 of the external tongue 17 is judiciously located practically at the center of flat parts 20 of this tip in order to obtain a more pronounced deformation of internal elastic flange 5, thus making it easiest to install and to remove the tip.

The blast pipe tip, which is the subject of this invention and whose various methods of fabrication described above as examples are non-limiting, uses simple and inexpensive methods to obtain substantial advantages over the blast pipe tips which preceded it in the state of the art.

Accordingly, while many modifications and variations of the invention are obvious in light of the teachings herein, it is to be understood that within the scope of the appended claims, the invention may be practiced otherwise than as specifically described herein.

We claim:

1. A one-piece tip for a foundry core blast pipe made of plastic material, having a large central bore intended for filling, which comprises:

an essentially cylindrical portion with one end thereof to be connected to said blast pipe, and a second end thereof to contact a core mold;

a coupling cone extending from said second end of said essentially cylindrical portion and ending at its lower extremity in a circular rim, for disposition in a filling hole of the core mold; said second end surface of said essentially cylindrical portion including an essentially circular shoulder outside said coupling cone which provides elastic support on the upper wall of said core mold, thus producing a tight seal by exerting horizontal thrust on said core mold; and means forming a narrow groove in said second end surface of said essentially cylindrical portion, at the junction between said essentially circular shoulder and said coupling core, so as to improve, by elastic deformation of said shoulder, the tightness of said seal that is obtained by its support on said upper wall of said core mold.

2. A tip for a foundry core blast pipe, as set forth in claim 1, further comprising:

an internal elastic flange and an adjacent recessed groove formed at said one end of said essentially cylindrical portion, said flange adapted to be fitted into a groove of said blast pipe; and at least one small external tongue extending radially from said essentially cylindrical portion which may be pulled so as to deform said internal elastic flange of said tip in order to facilitate its installation and extraction.

3. A tip for a foundry core blast pipe, as set forth in claim 2, wherein said small external tongue is equipped, at the end opposite to that by which it is attached to said essentially cylindrical portion, with a bead portion which reinforces and facilitates gripping of said tongue.

4. A tip for a foundry core blast pipe, as set forth in claim 2, wherein said tip is oblong in shape and the point of attachment of said external tongue is located essentially at the center of a part of minimum curvature of said tip in order to obtain maximum deformation of said internal elastic flange.

* * * * *